US006837740B2

(12) United States Patent
Kunishi et al.

(10) Patent No.: US 6,837,740 B2
(45) Date of Patent: Jan. 4, 2005

(54) FLAT CIRCUIT CONNECTOR

(75) Inventors: Shinsuke Kunishi, Hatano (JP); Tomisaburo Yamaguchi, Yokohama (JP)

(73) Assignee: Molex Incorporated, Lisle, IL (US)

( * ) Notice: Subject to any disclaimer, the term of this patent is extended or adjusted under 35 U.S.C. 154(b) by 59 days.

(21) Appl. No.: 10/357,965

(22) Filed: Feb. 4, 2003

(65) Prior Publication Data

US 2003/0157829 A1 Aug. 21, 2003

(30) Foreign Application Priority Data

Feb. 19, 2002 (JP) ..... 2002-41204

(51) Int. Cl.[7] ..... H01R 12/24

(52) U.S. Cl. ..... 439/495; 439/357; 439/260; 439/267

(58) Field of Search ..... 439/492–499, 439/260, 267, 357–358, 329

(56) References Cited

U.S. PATENT DOCUMENTS 4,630,874 A * 12/1986 Renn et al. ..... 439/263
5,240,430 A * 8/1993 Soes ..... 439/260
6,206,723 B1 * 3/2001 Kunishi ..... 439/495
6,276,958 B1 * 8/2001 Chih ..... 439/495

* cited by examiner

*Primary Examiner*—Truc T. T. Nguyen
(74) *Attorney, Agent, or Firm*—Stephen Z. Weiss

(57) ABSTRACT

An electrical connector is provided for terminating a flat electrical circuit having a bottom surface and a top surface. The connector includes a dielectric housing having an opening for receiving an end of the flat circuit. A plurality of terminals are mounted on the housing spaced laterally along the opening. At least some of the terminals have first flexible contact arms for engaging the bottom surface of the flat circuit and second flexible contact arms for engaging the top surface of the flat circuit. An actuator is movably mounted on the housing for movement between an open position allowing the flat circuit to be inserted into the opening and a closed position engaging the top surface of the flat circuit and biasing the bottom surface of the circuit against the first flexible contact arms. The first and second flexible contact arms are coupled to each other such that the first contact arms pull the second contact arms into engagement with the top surface of the flat circuit when the actuator is moved to its closed position.

8 Claims, 7 Drawing Sheets

FLAT CIRCUIT CONNECTOR

FIELD OF THE INVENTION

This invention generally relates to the art of electrical connectors and, particularly, to a connector for terminating a flat circuit, such as a flat flexible circuit, a flexible printed circuit or other flat electrical cable.

BACKGROUND OF THE INVENTION

A wide variety of electrical connectors have been designed for terminating flat cables or circuits, such as flat flexible cables, flexible printed circuits or the like. A typical connector for flat circuits includes a dielectric housing molded of plastic material, for instance. The housing has an elongated opening or slot for receiving an end of the flat circuit which has generally parallel, laterally spaced conductors exposed across the end. A plurality of terminals are mounted in the housing and are spaced laterally along the slot, with contact portions of the terminals engageable with the laterally spaced conductors of the flat circuit. An actuator often is movably mounted on the housing for movement between a first position whereat the flat circuit is freely insertable into the slot and a second position whereat the actuator clamps the circuit in the housing and biases the circuit against the contact portions of the terminals. Typical connectors of this type can be seen in Japanese Patent Laid-Open Nos. 9-97655; 10-214661; 11-31561; 11-54218; 12-48886; 12-106238; 13-76794; 13-110483; and others.

As stated above, conductors are spaced laterally along the insertion end of the flat circuit. The conductors may be exposed at a top surface of the circuit, or the conductors may be exposed at a bottom surface of the circuit. For instance, if a circuit has a finite length, conductors may be exposed at the top surface at one end of the circuit, and at the bottom surface at the opposite end of the circuit. The connector typically is fixed to a support structure or mounted on top of a printed circuit board., and the connector, therefore, cannot be turned upside-down to accommodate different circuits with the exposed conductors on the top or bottom surfaces of the circuits. Therefore, in such cases, two types of flat circuit connectors are required, one having terminals with contact portions for engaging the top surface of a flat circuit and another having terminals with contact portions for engaging the bottom surface of a circuit. This, of course, leads to problems in inventory management and increased manufacturing costs. Another example of this problem is where a flat circuit has conductors at opposite ends thereof and on the same side (top or bottom) thereof, and the circuit is terminated in a U-shaped configuration. Attempts have been made to solve this problem by providing connectors with enlarged cavities to accommodate different configurations of terminals, but this approach results in a larger connection space, thereby increasing the overall size of the connector in environments wherein compactness and low profiles are not only desirable but, in some cases, necessary.

The present invention is directed to solving these problems by providing an electrical connector for a flat circuit, wherein the connector can terminate a flat circuit having conductors on the top surface thereof, the bottom surface thereof or both surfaces.

SUMMARY OF THE INVENTION

An object, therefore, of the invention is to provide a new and improved electrical connector for terminating a flat electrical circuit having a bottom surface and a top surface, with conductors on either or both surfaces thereof.

In the exemplary embodiment of the invention, the connector includes a dielectric housing having an opening for receiving an end of the flat circuit in a circuit-insertion direction. A plurality of terminals are mounted on the housing in a side-by-side array and spaced laterally along the opening. Each of at least some of the terminals have a first flexible contact arm for engaging the bottom surface of the flat circuit and a second flexible contact arm for engaging the top surface of the flat circuit. An actuator is movably mounted on the housing for movement between an open position allowing the flat circuit to be inserted into the opening, and a closed position engaging the top surface of the flat circuit and biasing the bottom surface of the circuit against the first flexible contact arms. The first and second flexible contact arms of each terminal are coupled to each other such that the first contact arm pulls the second contact arm into engagement with the top surface of the flat circuit when the actuator is moved to its closed position.

According to one aspect of the invention, the first and second flexible contact arms extend in a direction away from a base of each terminal opposite the circuit-insertion direction. The first and second flexible contact arms define a slot therebetween for receiving the end of the flat circuit. The terminals include a U-shaped portion defining a pair of legs which form the first and second flexible contact arms.

According to another aspect of the invention, the housing includes shelf means opposing the second flexible contact arms of the terminals and engageable with the bottom surface of the flat circuit when the second flexible contact arms are pulled into engagement with the top surface of the circuit. As disclosed herein, the shelf means is provided by a plurality of shelves disposed in the opening in the housing between the terminals.

According to a further aspect of the invention, some of the terminals comprise pivot terminals having pivot means for engaging a pivot portion of the actuator to mount the actuator for pivotal movement between its open and closed position. The pivot means prevent shifting movement of the actuator generally parallel to the circuit insertion direction as well as in one direction generally perpendicular to the circuit-insertion direction. Other of the terminals comprise cam terminals for engaging the actuator and preventing shifting of the actuator in a direction opposite the one direction generally perpendicular to the circuit-insertion direction.

A feature of the invention involves a reinforcement fitting mounted on the housing for mounting the connector on a substrate, such as a printed circuit board. The fitting and the actuator have complementary interengaging latch means for holding the actuator in its closed position.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 2(*b*) is a view similar to that of FIG. 2(*a*), but showing one of the cam terminals;

DETAILED DESCRIPTION OF THE PREFERRED EMBODIMENT

Figure 1:
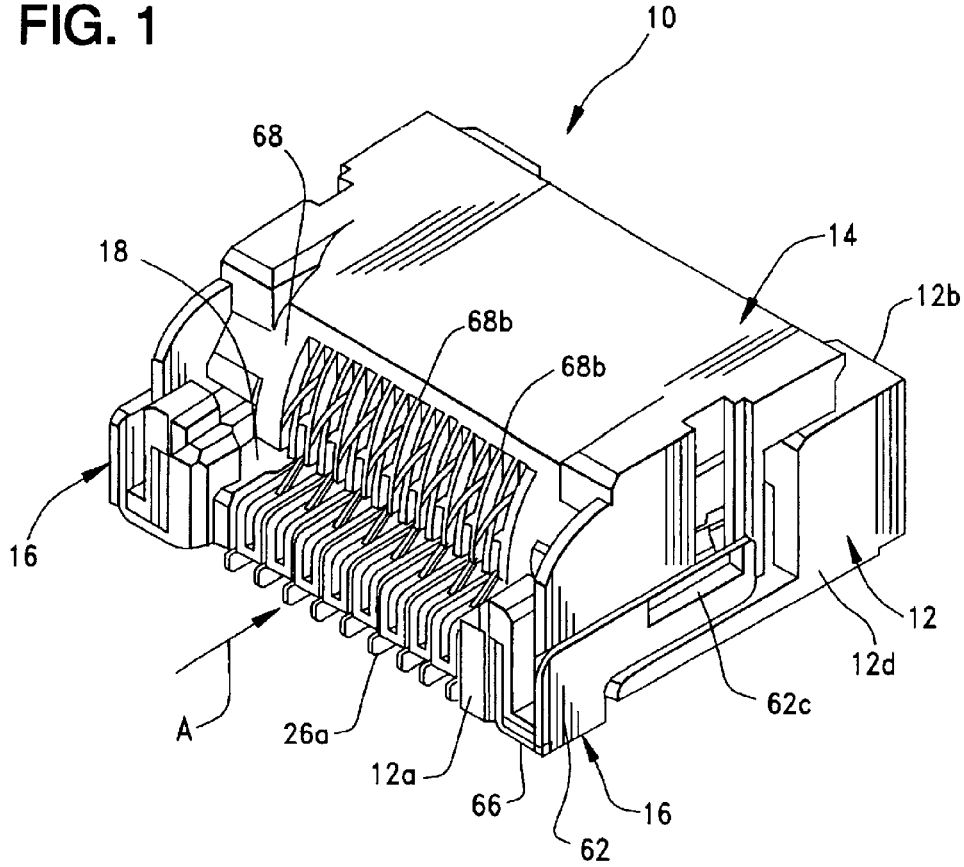
FIG. 1 is a perspective view of an electrical connector embodying the concepts of the invention, with the actuator in its closed position.

Referring to the drawings in greater detail, and first to FIG. 1, the invention is embodied in an electrical connector, generally designated 10, for terminating a flat electrical circuit (described hereinafter) having a bottom surface and a top surface. Generally, the connector is designed for terminating the flat circuit whether the circuit has conductors on the top surface thereof, the bottom surface thereof or both.

Figure 14:
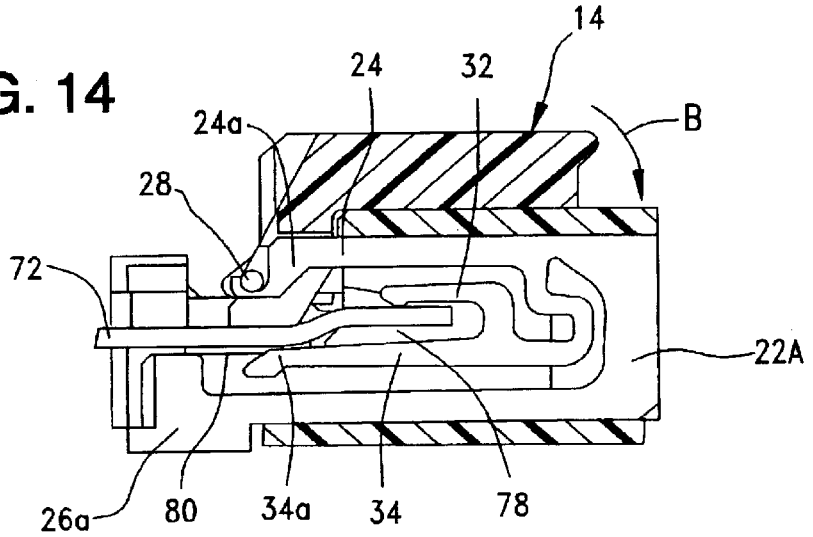
Figure 15:
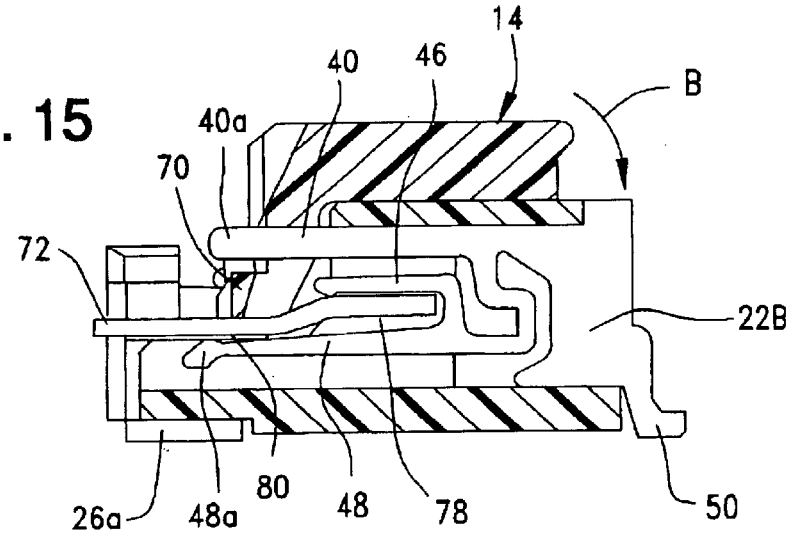

With that understanding, connector 10 includes a dielectric housing, generally designated 10, for movably mounting an actuator, generally designated 14, for pivotal movement between an open position allowing the flat circuit to be inserted into the housing, and a closed position shown in FIG. 14 for terminating the circuit, as described hereinafter. The housing is generally rectangular and includes a front end 12*a*, a rear end 12*b*, a top wall 12*c* and side walls 12*d*. Housing 12 is adapted for mounting on a printed circuit board (not shown), and a pair of metal reinforcement fittings, generally designated 16, are mounted on the housing and may be affixed, as by soldering, to appropriate mounting pads on the printed circuit board. The housing defines an opening in the form of an elongated slot 18 for receiving an end of the flat circuit in a circuit-insertion direction as indicated by arrow "A".

Figure 2A:
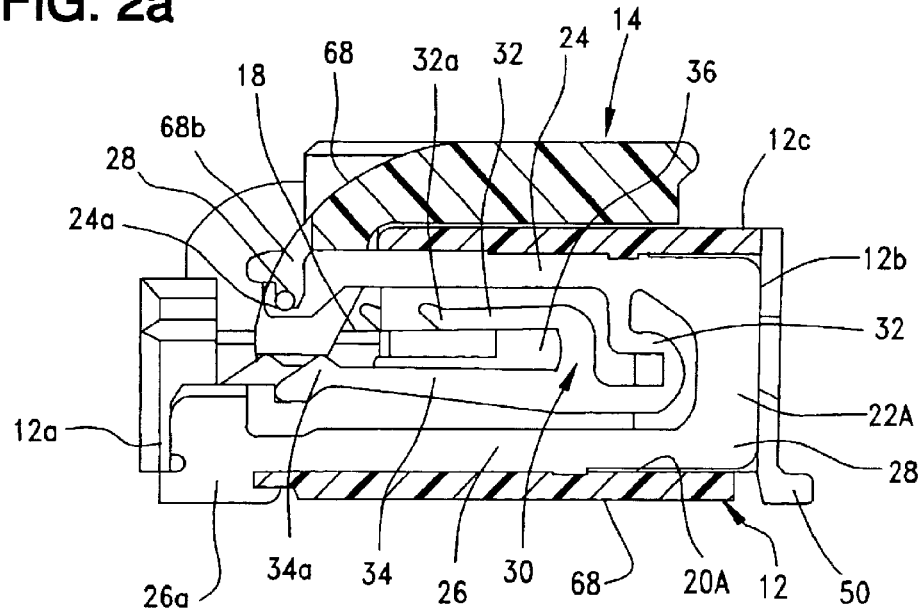
FIG. 2(*a*) is a front-to-rear section through the connector to illustrate one of the pivot terminals.
Figure 2B:
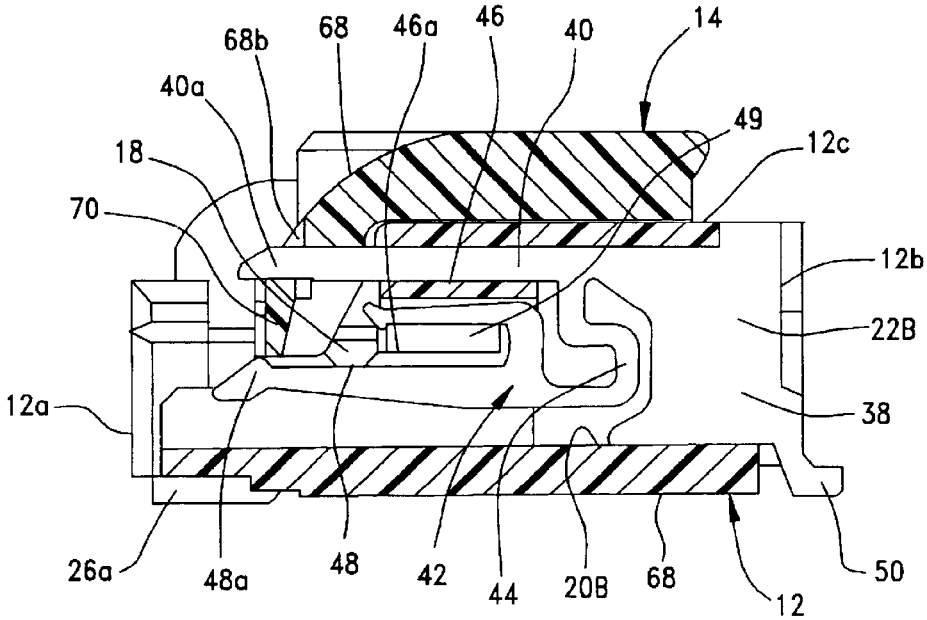

Referring to FIGS. 2(*a*) and 2(*b*) in conjunction with FIG. 1, housing 12 includes a plurality of alternating cavities or terminal-receiving passages 20A (FIGS. 2(*a*)) and 20B (FIG. 2(*b*)) which are spaced alternatively along circuit-receiving slot 18. Passages 20A and 20B receive and mount two different terminals and 22A and 22B, respectively, alternatingly along slot 18. Terminal 22A is inserted into passage 20*a* from the front or left-hand side of housing 12 as viewed in FIG. 2(*a*), and terminal 22B is inserted into passage 20B from the rear or right-hand side of the housing as viewed in FIG. 2(*b*).

Terminals 22A will be termed "pivot" terminals herein. Each pivot terminal 22A includes an upper mounting arm 24 and a lower mounting arm 26 which engage the top and bottom of housing 12 within passage 20A. The arms project forwardly from a rear base 28 of the terminal. Lower mounting arm 26 has a foot portion 26*a* at the front distal end thereof for connection, as by soldering, to an appropriate circuit trace on the printed circuit board. The front distal end of upper mounting arm 24 defines a pivot portion 24*a* which is in the form of a saddle for receiving a pivot pin 28 on actuator 14 to pivotally mount the actuator on the connector. A U-shaped contact portion, generally designated 30, is joined by a spring bend 32 to base 28 at a proximal end of upper mounting arm 24. The legs of the U-shaped contact portion 30 defines an upper flexible contact arm 32 and a lower flexible contact arm 34. Upper flexible contact arm and lower flexible contact arm 34 terminate in opposing contact portions 32*a* and 34*a*, respectively. As will be seen hereinafter, the flexible contact arms define a slot 36 into which an end of the flat circuit is insertable.

Referring to FIG. 2(*b*), terminals 22B will be referred to herein as "cam" terminals. Each cam terminal includes a base 38 mounted in passage 20B, with an upper mounting arm 40 projecting forwardly of the base and engageable with the housing at the top or roof of passage 20B. Upper mounting arm 40 terminates in a cam portion 40*a* at the front distal end thereof. Like the pivot terminals, each cam terminal 22B includes a generally U-shaped contact portion, generally designated 42, connected to the base of the terminal by a spring bend 44 at the proximal end of upper mounting arm 40. The U-shaped contact portion defines an upper flexible contact arm 46 and a lower flexible contact arm 48 which define a circuit-receiving slot 49 therebetween. Upper flexible contact arm 46 and lower flexible contact arm 48 define opposing contact portions 46*a* and 48*a*, respectively. Finally, each cam terminal 22B has a foot portion 50 for connection, as by soldering, to an appropriate circuit trace on the printed circuit board.

Figure 3:
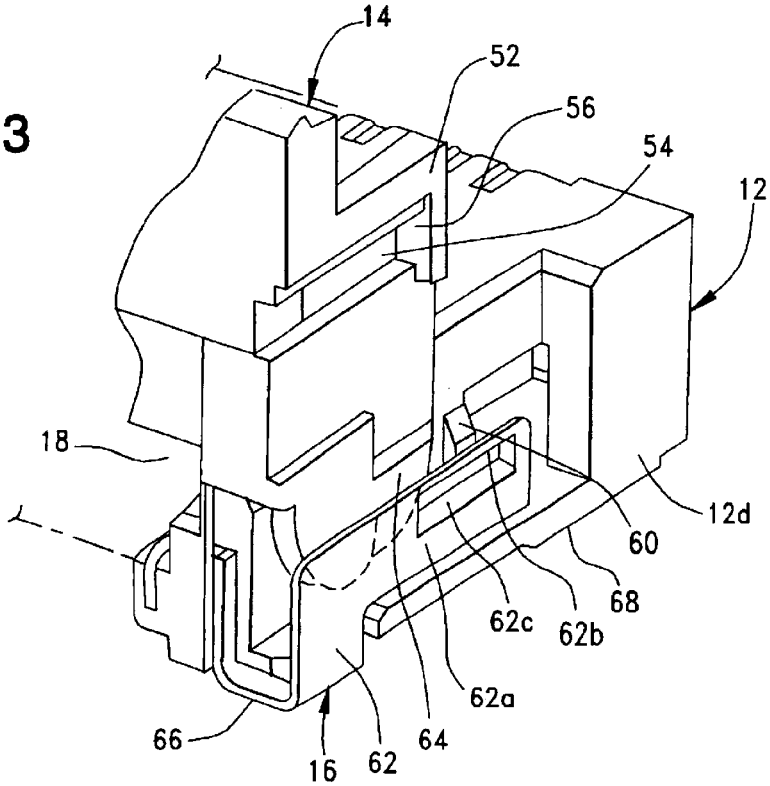
FIG. 3 is an enlarged, fragmented perspective view of the right-hand end of the connector as shown in FIG. 1, with the actuator in its open position.
Figure 4:
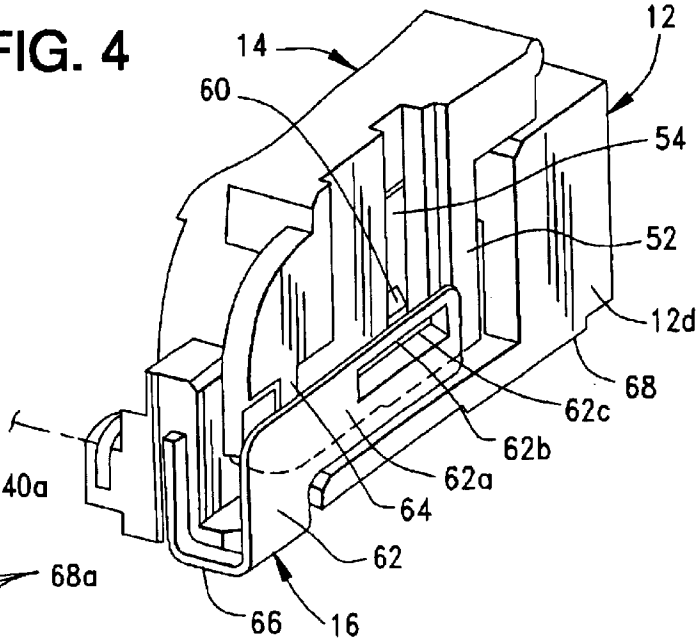
FIG. 4 is a view similar to that of FIG. 3, with the actuator in its closed position.

FIG. 3 shows actuator 14 in its open position for allowing the flat circuit to be inserted into slot 18, and FIG. 4 shows the actuator in its closed position. The actuator has opposite side walls 52, and each side wall has an opening 54 which defines a latching ledge 56. A chamfered latch projection is formed on each side wall 12*d* of the housing. When actuator 14 is moved from its open position shown in FIG. 3 to its closed position shown in FIG. 4, side walls 52 are biased outwardly upon engagement with chamfered latch projections 60 until the latch projections snap into openings 54 as seen in FIG. 4, to latch the actuator in its closed position. This is facilitated if actuator 14 is fabricated of sufficiently flexible plastic material.

A redundant latching system is provided for actuator 14, between the actuator and reinforcement fittings 16. Still referring to FIG. 3 and 4, each metal reinforcement fitting includes an outside wall 62 having a flexible engagement flange 62*a* with a latch opening 62*b* therein. The material of the latch opening is bent inwardly to define a latching ledge 62*c*. When the actuator is moved to its closed position, latching ledge 62*c* snaps over latching ledge 56 to further latch the actuator in the closed position. In addition, the actuator has a vertical projection 64 which extends behind outside wall 62 of reinforcement fitting 16. This vertical projection engages latching ledge 62*c* as seen in FIG. 3, to maintain the actuator in its open position without supporting the actuator by hand. Finally FIG. 3 and 4 show that reinforcement fittings 16 have bottom feet 66 for connection, as by soldering, to appropriate mounting pads on the printed circuit board. A bottom surface 68 of housing 12 is adapted for mounting on the top surface of the printed circuit board.

Figure 5:
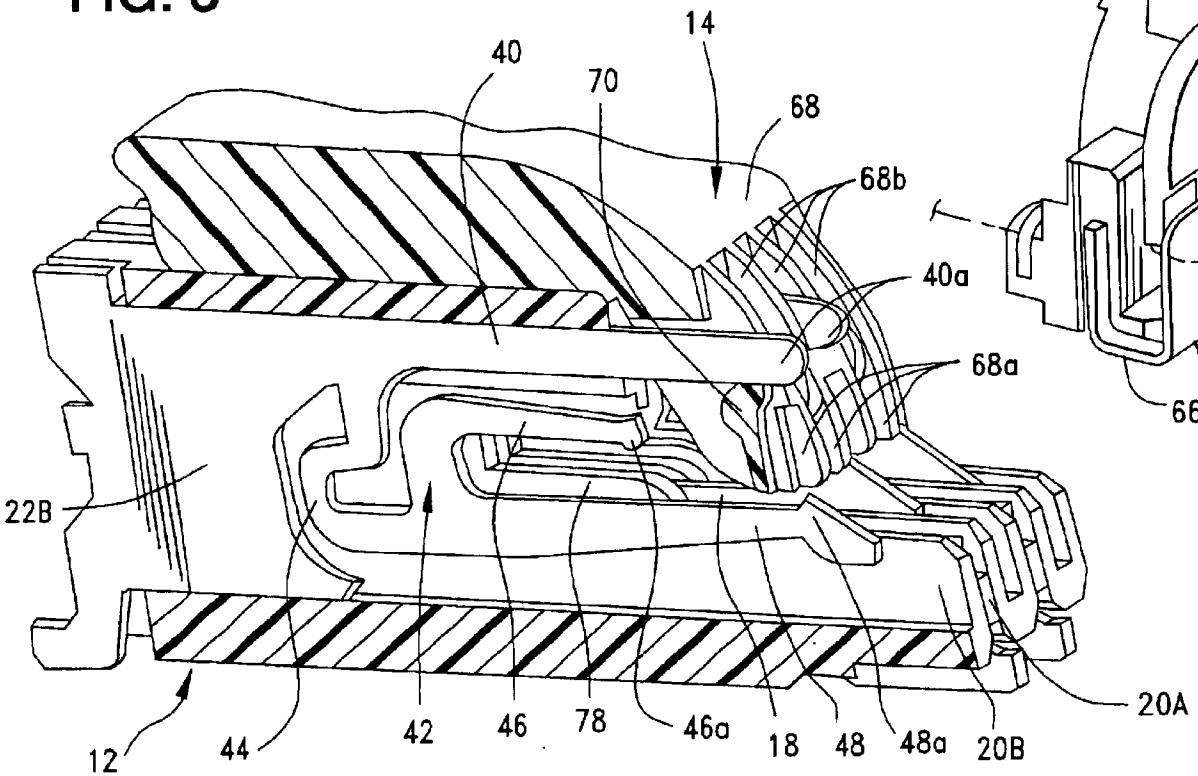
FIG. 5 is a further enlarged, fragmented and sectional perspective view showing one of the terminal-mounting cavities in the housing.

FIG. 5 shows that actuator 14 has an engagement portion 68 which defines a plurality of circuit-engaging ribs 68*a*. The ribs define slots 68*b* therebetween for accommodating the upper mounting arms of the terminals, such as upper mounting arm 40 of cam terminal 22B shown in FIG. 5. It can be seen that a cam 70 is formed between adjacent ribs 68*a* for engagement beneath cam portions 40*a* when actuator 14 is in its closed position. In essence, cams 60 and pivot pins 28 (FIG. 2(*a*)) alternate between ribs 68*a* for the alternating cam terminals and pivot terminals, respectively.

Figure 6:
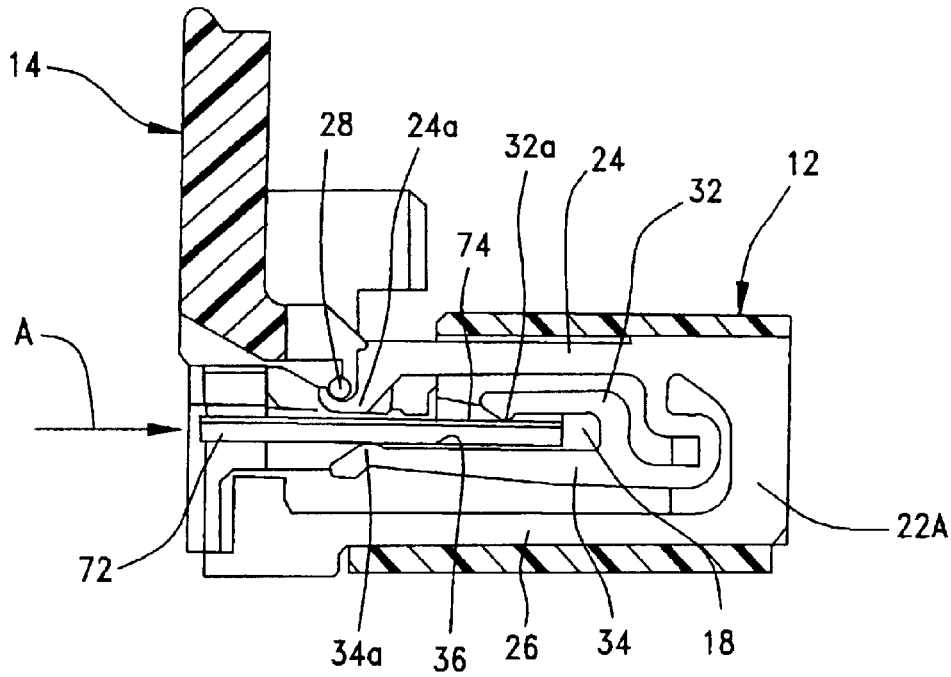
FIG. 6 is a view similar to that of FIG. 2(*a*), but with a flat circuit inserted into the connector and with the actuator in its open position.
Figure 7:
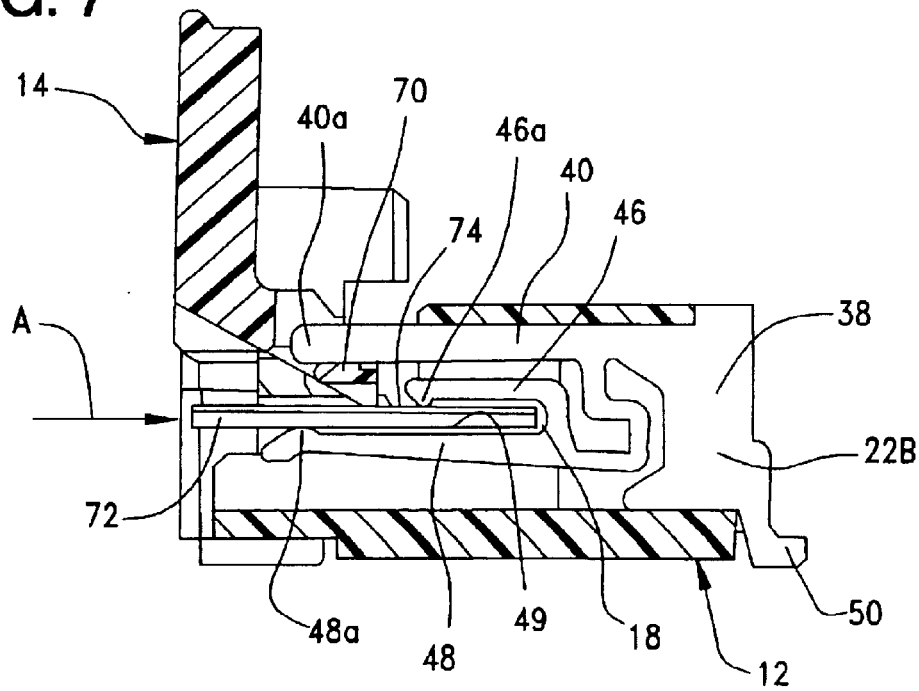
FIG. 7 is a view similar to that of FIG. 2(*b*), but with a flat circuit inserted into the connector and with the actuator in its open position.

FIGS. 6–10 show a flat circuit 72 having exposed conductors or contacts 74 on a top surface 76 thereof. FIGS. 6 and 7 show actuator 14 in its open position allowing the flat circuit to be inserted in the direction of arrow "A" into opening 18 of housing 12 and into slots 36 and 50 between the contact arms of pivot terminals 22A and cam terminals 22B, respectively. FIG. 6 shows pivot pins 28 of actuator 14 cradled in pivot portions 24*a* of upper mounting arms 24 of pivot terminals 22A. This prevents the actuator from shifting generally horizontally (i.e., generally parallel to the circuit-insertion direction "A") as well as downwardly in the vertical direction. FIG. 7 shows that cams 70 of the actuator are disposed beneath cam portions 40*a* of upper mounting arms 40 of cam terminals 22B. This prevents the actuator from moving in an upward direction. Therefore, the combination of pivot portions 24*a* of the pivot terminals and cam portions 40*a* of the cam terminals secure the actuator for its pivoting movement.

Figure 9:
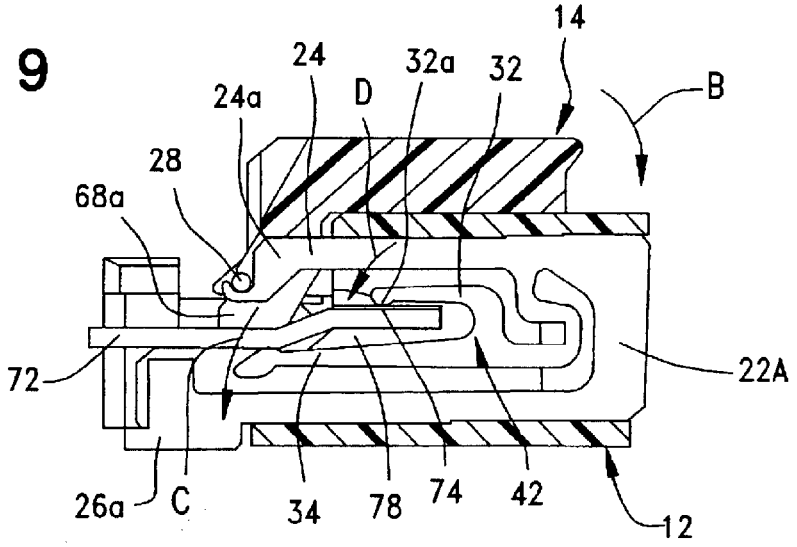
FIG. 9 is a view similar to that of FIG. 2(*a*), but with flat circuit terminated in the connector.
Figure 10:
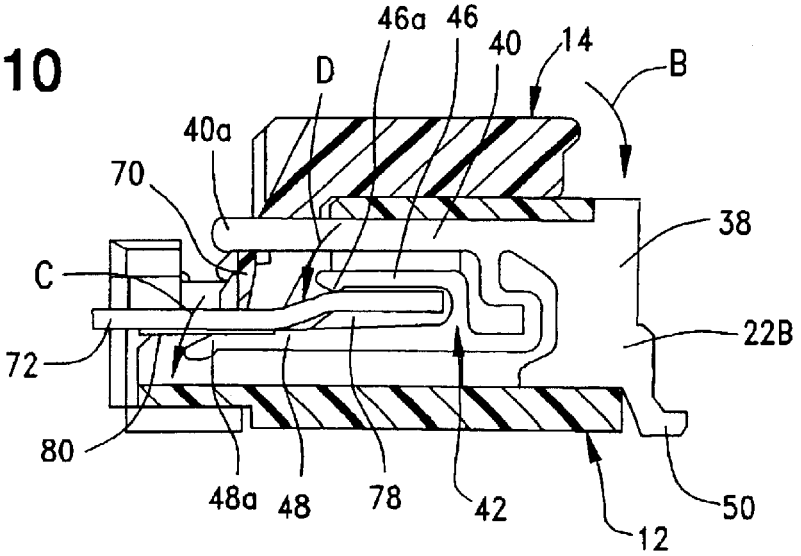
FIG. 10 is a view similar to that of FIG. 2(*b*), but with the circuit terminated in the connector.
Figure 11:
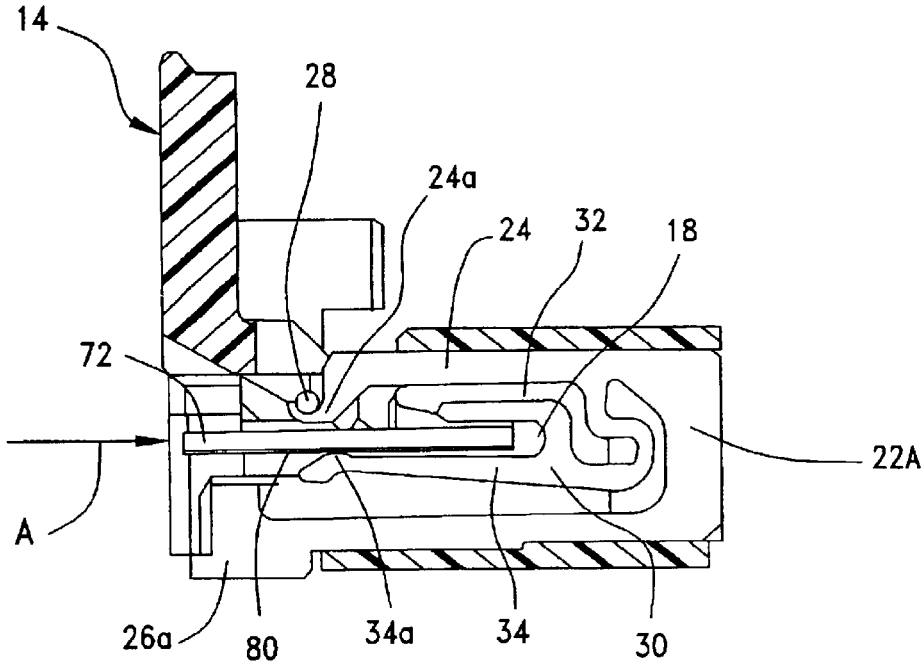
FIGS. 11–15 are views similar to that of FIG. 6-10, but with the conductors exposed at the bottom surface of the flat circuit.
Figure 12:
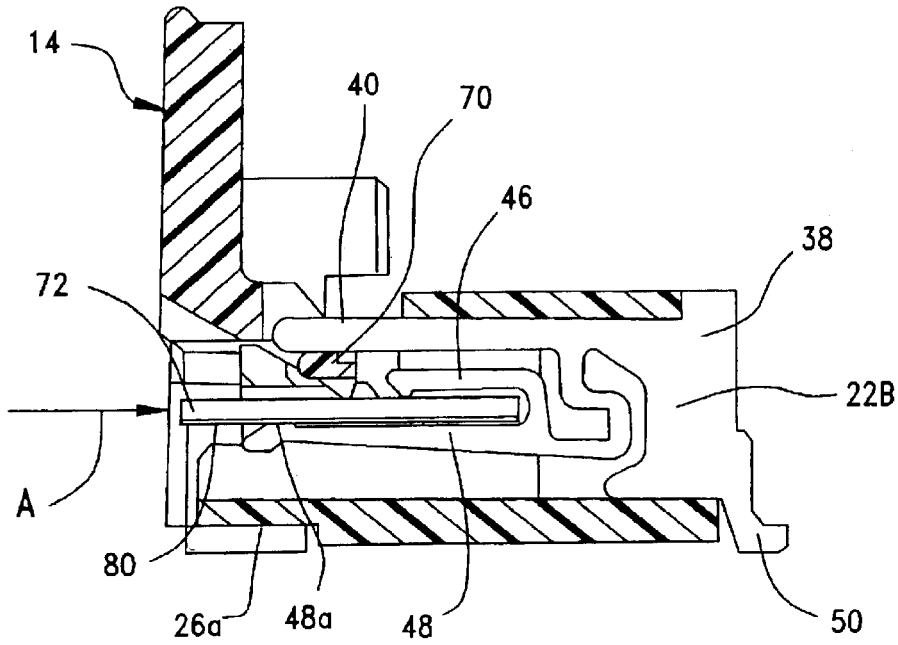

In the open position of FIGS. 6 and 7, flat circuit 72 is shown fully inserted into slots 36 and 50 between the flexible contact arms of pivot terminals 22A and cam terminals 22B. Contacts 74 on the top surface of the flat circuit oppose contact portions 32*a* and 46*a* at the distal ends of flexible contact arms 32 and 46, respectively, of pivot terminals 22A and cam terminals 22B, respectively. When actuator 14 is pivoted downwardly in the direction of arrows "B" as seen in FIGS. 9 and 10, engaging ribs 68*a* of the actuator engage flat circuit 72 and bias the circuit downwardly in the direction of arrows "C" against lower flexible contact arms 34 and 48 of pivot terminals 22A and cam terminals 22B. Cams 70 (FIG. 10) also bias the flat circuit against the lower flexible contact arms. Since the lower contact arms are integral with upper contact arms 32 and 46, and due to the unitary structure of U-shaped contact portions 30 and 42, movement of lower flexible contact arms 34 and 48 downwardly in the direction of arrows "C" is effective to pull upper contact arms 32 and 46 downwardly in the direction of arrows "D". This causes contact portions 32*a* and 46*a* of upper contact arms 32 and 46, respectively, to engage the conductors or contacts 74 on the top surface of flat circuit 72.

Generally, shelf means are provided in opposing relationship to upper contact arms 32 and 46 to sandwich the flat circuit therebetween and to provide an anvil means against which the upper contact arms bias the flat circuit. Specifically, the housing has a plurality of rib-like shelves 78 disposed between the terminals (see FIG. 5). The upper contact arms bias the flat circuit against this shelf means.

Figure 13:
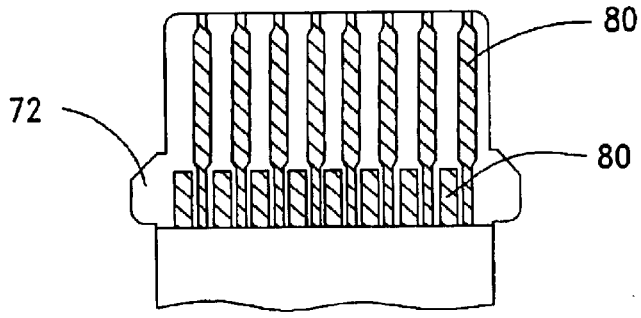

FIGS. 11-15 are substantially identical to FIG. 6-10, except, as seen in FIG. 13, flat circuit 72 has conductors or contacts 80 on the bottom surface thereof. The flat circuit is inserted into the connector in the direction of arrows "A" (FIGS. 11 and 12) the same as described above in relation to FIG. 6 and 7. Actuator 14 again is pivoted downwardly in the direction of arrows "B" (FIGS. 14 and 15) to its closed position. The biasing of the flat circuit is the same as described above in relation to FIGS. 8 and 9. However, in this instance, conductors or contacts 80 on the bottom surface of flat circuit 72 are biased into engagement with contact portions 34*a* and 48*a* of lower flexible contact arms 34 and 48, respectively, of pivot terminals 22A and cam terminals 22B.

Figure 8:
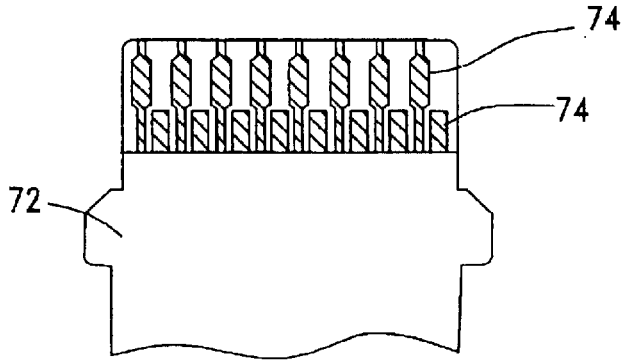
FIG. 8 is a plan view of an insertion end of a flat circuit having exposed conductors spaced laterally along a top surface thereof.

It should be noted that a unique capability of connector 10 according to the invention is that a flat circuit can be terminated with conductors or contacts exposed on both sides thereof. For instance, FIGS. 8 and 13 show different contact configurations which can be disposed on either or both sides of the flat circuits.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for terminating a flat electrical circuit having a bottom surface and a top surface, comprising:

a dielectric housing having an opening for receiving an end of the flat circuit in a circuit-insertion direction;

a plurality of terminals mounted on the housing in a side-by-side array and spaced laterally along the opening, each of at least some of the terminals having a first flexible contact arm for engaging said bottom surface of the flat circuit and a second flexible contact arm for engaging the top surface of the flat circuit;

an actuator movably mounted on the housing for movement between an open position allowing the flat circuit to be inserted into said opening and a closed position engaging the top surface of the flat circuit and biasing the bottom surface of the circuit against said first flexible contact arms; and the first and second flexible contact arms being coupled to each other such that the first contact arm pulls the second contact arm into engagement with the top surface of the flat circuit when the actuator is moved to its closed position.

2. The electrical connector of claim 1 wherein the first and second flexible contact arms extend in a direction away from a base of each terminal opposite said circuit insertion direction, the first and second flexible contact arms defining a slot therebetween for receiving said end of the flat circuit.

3. The electrical connector of claim 2 wherein each of said at least some of the terminals include a U-shaped portion defining a pair of legs which form said first and second flexible contact arms.

4. The electrical connector of claim 1 wherein said housing includes shelf means opposing said second flexible contact arms and engageable with the bottom surface of the flat circuit when the second flexible contact arms are pulled into engagement with the top surface of the flat circuit.

5. The electrical connector of claim 4 wherein said shelf means comprise a plurality of shelves disposed in said opening between said at least some of the terminals.

6. The electrical connector of claim 1 wherein some of said terminals comprise pivot terminals having pivot means for engaging a pivot portion of the actuator to mount the actuator for pivotal movement between said open and closed positions.

7. The electrical connector of claim 6 wherein said pivot means prevent shifting movement of the actuator generally parallel to aid circuit insertion direction as well as in one direction generally perpendicular to the circuit-insertion direction, and other of said terminals comprise cam terminals for engaging the actuator and preventing shifting of the actuator in a direction opposite said one direction generally perpendicular to the circuit-insertion direction.

8. The electrical connector of claim 1, including a reinforcement fitting mounted on the housing for mounting the connector on a substrate, the fitting and the actuator having complementary interengaging latch means for holding the actuator in its closed position.

* * * * *